US005607164A

United States Patent [19]

Rifkin

[11] Patent Number: 5,607,164

[45] Date of Patent: Mar. 4, 1997

[54] VEHICLE POSITIONING GAME

[75] Inventor: Andrew Rifkin, Palos Verdes, Calif.

[73] Assignee: Mattel, Inc., El Segundo, Calif.

[21] Appl. No.: 599,215

[22] Filed: Feb. 9, 1996

[51] Int. Cl.[6] ..... A63F 9/24

[52] U.S. Cl. ..... 273/446

[58] Field of Search ..... 273/445, 446; 434/258

[56] References Cited

U.S. PATENT DOCUMENTS 2,750,683 6/1956 Theobald ..... 273/446 X
4,913,432 4/1990 Barra ..... 273/446

FOREIGN PATENT DOCUMENTS 639912 7/1950 United Kingdom ..... 273/446

*Primary Examiner*—Paul E. Shapiro
*Attorney, Agent, or Firm*—Roy A. Ekstrand

[57] ABSTRACT

A game unit includes a pair of vertical slots within which a pair of toy vehicle carriages each supporting a toy vehicle are movable. An endless belt is supported beneath each of the carriages and secured thereto. The belt is driven by a reversible motor which in turn responds to an operator button to alternatively move the vehicle downward or stop the vehicle motion at a target point. A plurality of flashing lights and numeric scores are arranged in parallel columns adjacent each slot to identify a target zone within which the vehicle is to be stopped.

1 Claim, 3 Drawing Sheets

VEHICLE POSITIONING GAME

FIELD OF THE INVENTION

This invention relates generally to toy vehicle games and particularly to those requiring accurate judgment of speed and position for optimum play.

BACKGROUND OF THE INVENTION

Toy games in which the user operates or controls one or more toy vehicles upon a track are well known in the art. Thus, toy vehicle playsets or games have been provided which facilitate a variety of manipulations of toy vehicles on variously shaped tracks or surfaces. Of particular benefit in some games for the child user is the development of skills in judging space, distance and velocity in the operation of the game. Despite substantial advances in the art pertaining to such games, there remains nonetheless a continuing need for evermore interesting and exciting vehicle positioning type games.

SUMMARY OF THE INVENTION

Accordingly, it is a general object of the present invention to provide an improved toy vehicle game. It is a more particular object of the present invention to provide an improved toy vehicle game which challenges the operator's capability to accurately judge velocity and predict changes in toy vehicle velocity and position.

In accordance with the present invention there is provided a toy vehicle positioning game comprising: a housing defining a vertical slot having upper and lower ends; a toy vehicle; drive means for moving the toy vehicle from the upper end toward the lower end; a stop zone adjacent the lower end having means for indicating a target stop position within the stop zone; switch means for operating the drive means; and position means for detecting the position of the toy vehicle within the stop zone.

BRIEF DESCRIPTION OF THE INVENTION

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 1 sets forth a perspective view of a vehicle positioning game constructed in accordance with the present invention;

FIG. 2 sets forth an enlarged partial view of the stopping zone of the present invention vehicle positioning game; and FIG. 3 sets forth an operational diagram of the vehicle moving and stopping mechanism of the present invention game.

DESCRIPTION OF THE PREFERRED EMBODIMENT

Figure 1:
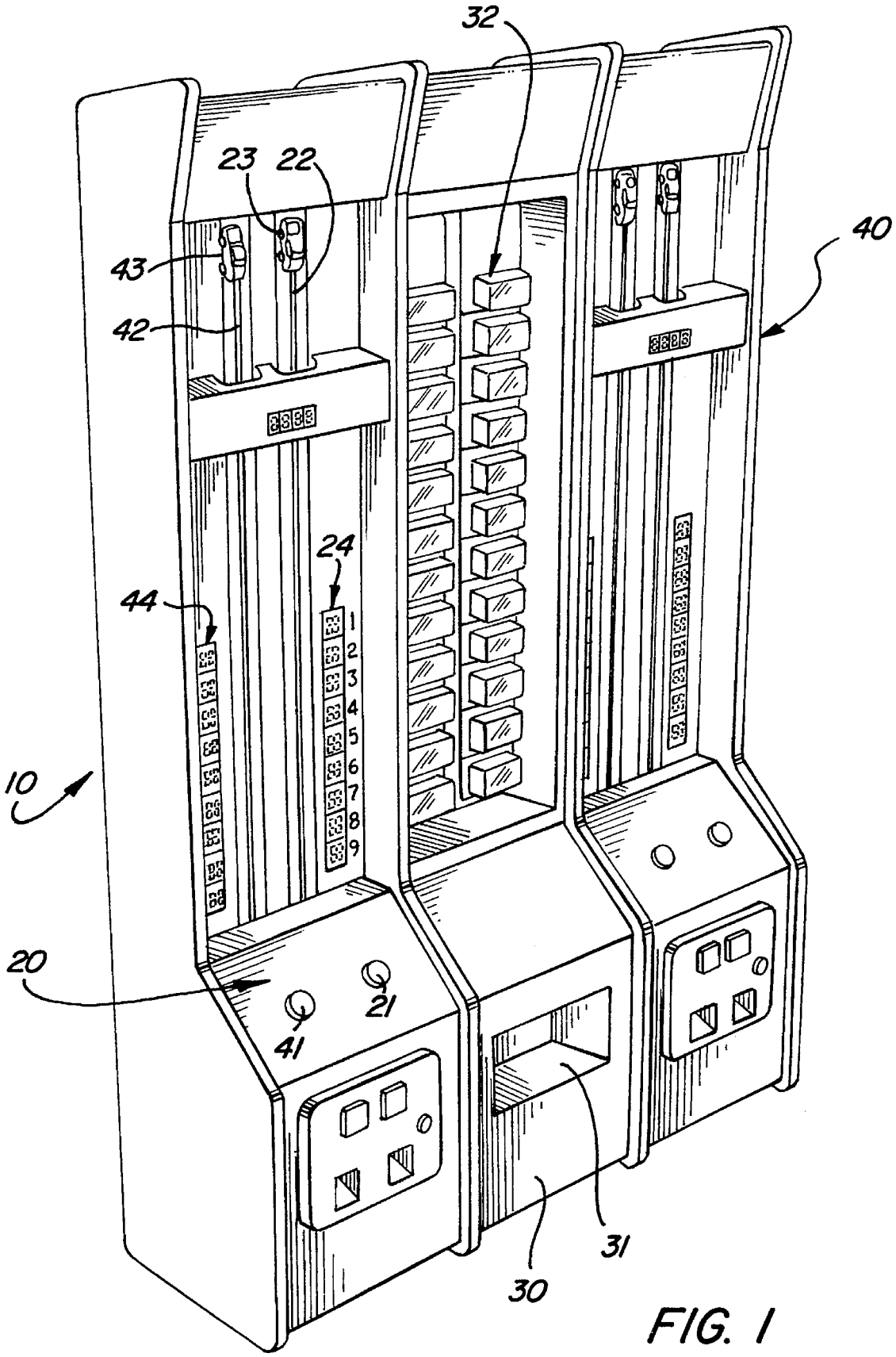

FIG. 1 sets forth a perspective view of a vehicle positioning game constructed in accordance with the present invention and generally referenced by numeral 10. At the outset, it should be noted that game 10 includes a pair of identical game units 20 and 40 positioned on each side of a center vending unit 30. Vending unit 30 includes a vending slot 31 at the lower portion thereof and a plurality of to-be-vended products forming a product supply 32 in the upper portion thereof. Inasmuch as game unit 20 and game unit 40 are identical, game unit 20 will be described below in greater detail with the understanding that the descriptions applied thereto are equally applicable to and descriptive of identical game unit 40. More specifically, game unit 20 includes a first operator button 21 positioned beneath a vertically extending track slot 22. By means set forth below in greater detail, a toy vehicle 23 is movable vertically within slot 22. At the lower end of slot 22, an adjacent column of lights 24 are positioned in a vertical array. In addition, a column of numbers are also positioned adjacent lights 24. Game unit 20 further includes a second operator button 41 positioned beneath a vertically extending slot 42 within which a second vehicle 43 is movable by means set forth below in greater detail. In further similarity or correspondence to lights 24 and number array 25, a vertical arrangement of lights 44 together with a plurality of numbers 45 (seen in FIG. 2) are positioned adjacent the lower portion of slot 42. With temporary reference to FIG. 2 there is set forth therein an enlarged view of the stopping zone of the present invention game. Suffice it to note here that adjacent each of slots 22 and 42 are corresponding columns of lights and numbers, the relevance of which is set forth below.

In operation with vehicles 23 and 43 positioned at the upper end of slots 22 and 42 respectively, a randomly selected light from among light array 24 begins flashing signaling the initiation of the game play. Thereafter, the operator presses button 21 initiating the downward travel of vehicle 23. The downward travel of vehicle 23 is terminated when the operator releases button 21. The objective is to align a pointer element on vehicle 23 with the particular of the lights within light array 24 which is flashing. Once vehicle 23 has been brought to a stop, it remains as positioned and the player then moves to button 41 and awaits a randomly selected one of light array 44 to begin flashing. Once a light within light array 44 flashes, the process is repeated as button 41 is held down and vehicle 43 drops downwardly and the operator attempts to release button 41 so as to stop vehicle 43 in alignment with the particular one of lights 44 which is flashing. Once the operator has stopped vehicles 23 and 43, the player's term is over.

Player performance is evaluated as follows. In the event the player is able to stop both vehicles in proper alignment with the flashing light within each light array, the maximum score is obtained and vending unit 30 is activated to dispense one of the products from product supply 32 outwardly through then slot 31. If, however, on the initial operation of vehicle 23 the operator is unable to stop vehicle 23 in alignment with the flashing light, the number opposite the actual position of vehicle 23 is selected as a base number. Thereafter, as the player operates vehicle 43 using button 42, the operator's objective having failed in the operation of vehicle 23 is to stop vehicle 43 opposite the highest number within number array 45. Once this is complete, scoring for the player's turn is numerically equal to the product of the base number, the number opposite the stopping point of vehicle 23, times the multiplier, the number opposite the stopping position of vehicle 43. This multiplied product is the score utilized in evaluating the player's performance.

Thus, as each player approaches game play, the objective is to operate the first vehicle so as obtain alignment with the flashing light. Failing in that, the operator then ignores the flashing light in the second array when operating vehicle 43 and instead attempts to align the vehicle at its stopping position with the highest value multiplier from among number array 45 (seen in FIG. 2).

As is set forth below in greater detail, the operation of the present invention game is rendered more challenging and interesting by the use of a spring-loaded idler pulley within the drive system which avoids jerky, abrupt stops and provides instead a more gradual termination of downward motion.

Figure 2:
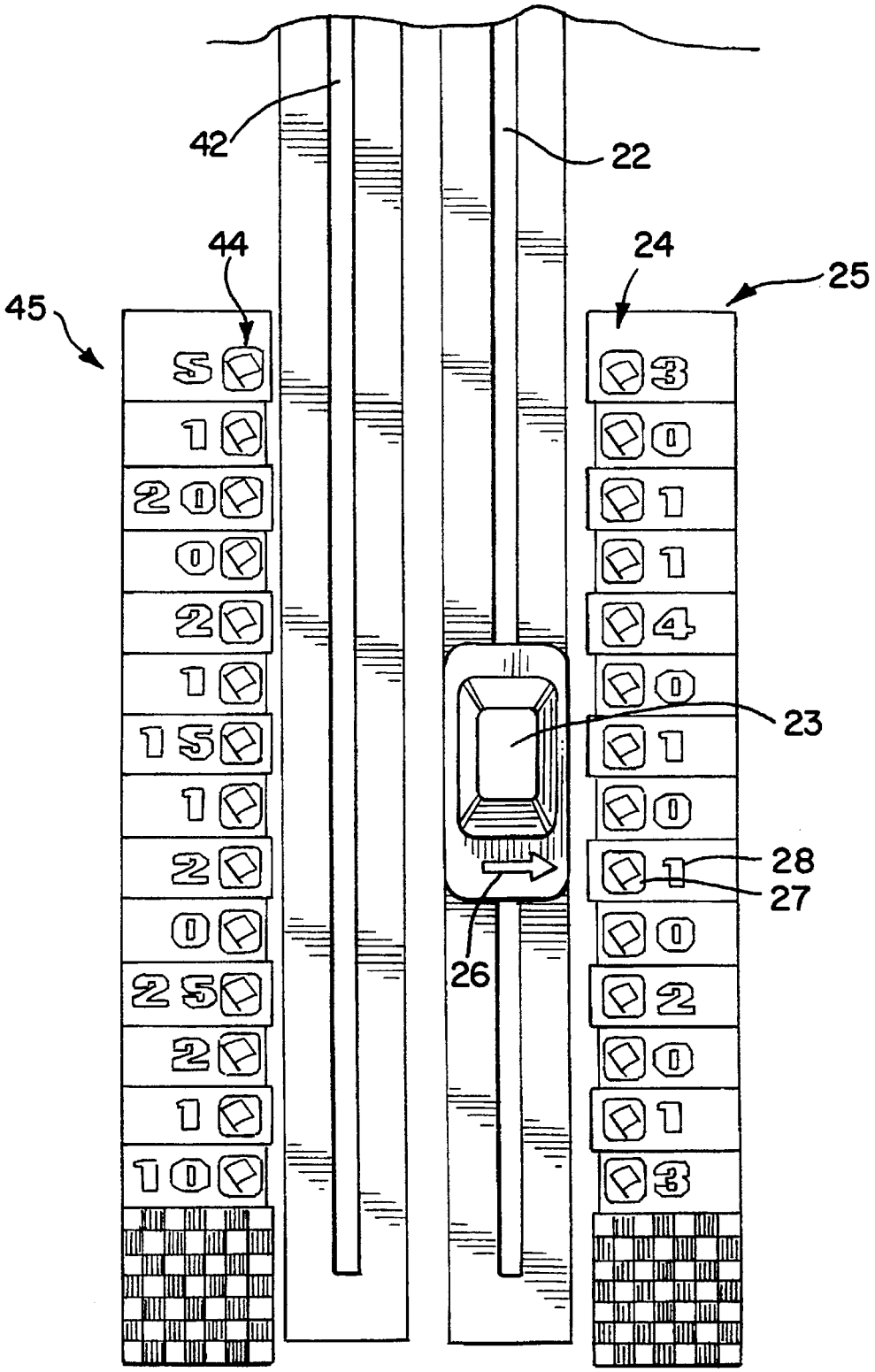

FIG. 2 sets forth an enlarged partial view of the stopping zone of game unit 20. Once again, it should be understood that game unit 40 (seen in FIG. 1) is identical to game unit 20 and thus includes a stopping zone which is identical to that shown in FIG. 2. As described above, game unit 20 supports a pair of vertically extending slots 22 and 42 in a parallel arrangement. At the lower end of slots 22 and 42, a plurality of lights 24 and a plurality of lights 44 are positioned in a columnar arrangement adjacent slots 22 and 42 respectively. In the embodiment shown in FIG. 2, lights 24 and 44 bear checkered flag emblems thereon. However, it will be apparent to those skilled in the art that virtually any indicia may be provided to indicate a target stopping point along slots 22 and 42. A plurality of numbers 25 form a second columnar adjacent lights 24 with each light having a correspondingly aligned one of numbers 25. Similarly, a plurality of numbers 45 is arranged in a columnar arrangement adjacent lights 44 such that each of lights 44 has an adjacent number. A toy vehicle 23 bearing a pointer 26 is shown having stopped within the stopping zone of game unit 20 such that pointer 26 is aligned with a light 27 next to which is positioned a number 25. In the event that light 27 is the particular light from light array 24 which is flashing, then the operator having stopped vehicle 23 as shown has successfully completed the first portion of game play. If not, however, the number one corresponding to number 28 forms the above-described base number in scoring the operator's play. The game play continues with the operator attempting to position vehicle 43 (seen in FIG. 1) adjacent a target one of lights 44 and numbers 45.

Figure 3:
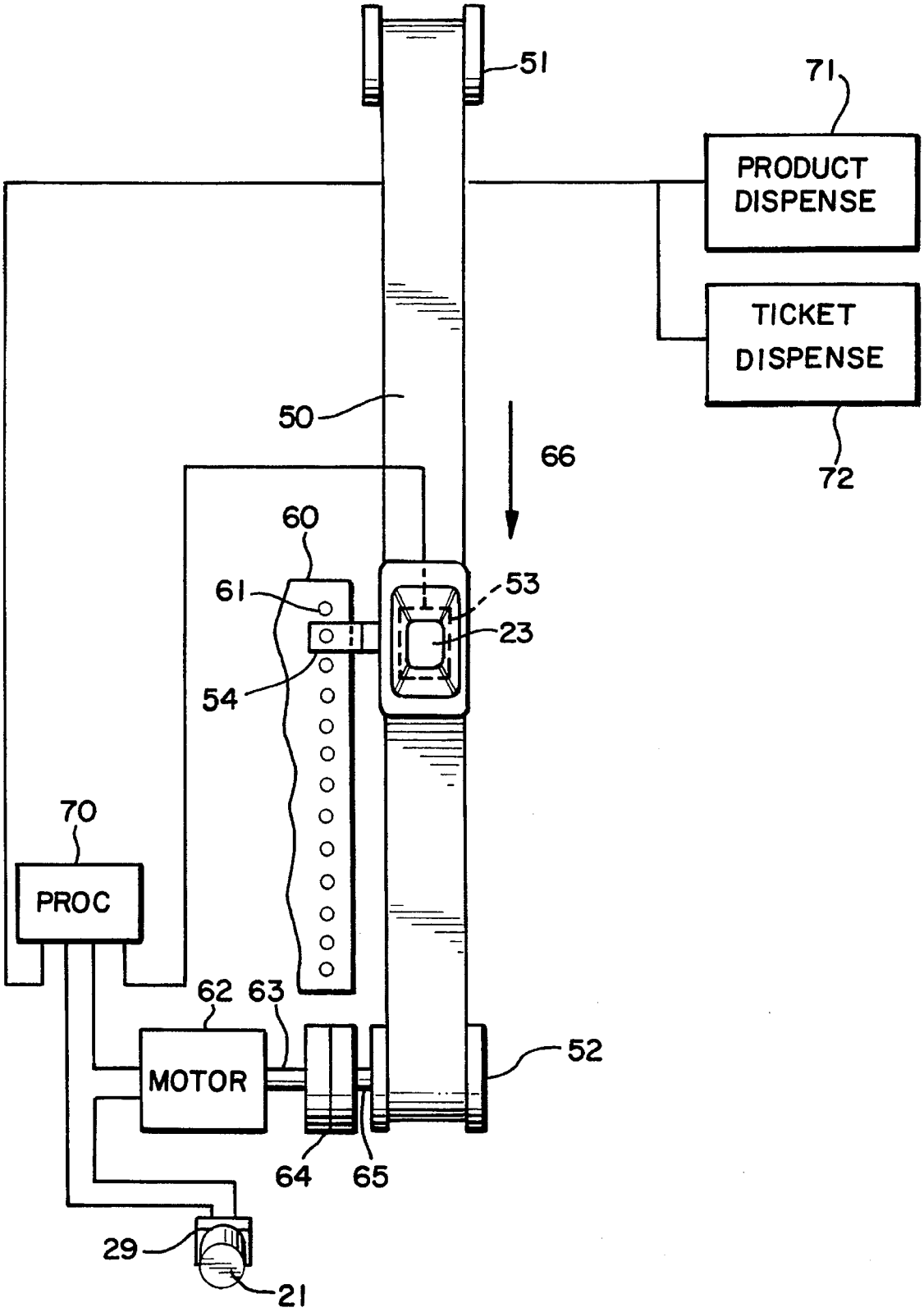

FIG. 3 sets forth an operational diagram of the vehicle movement apparatus operative upon vehicle 23. It should be apparent to those skilled in the art that a second set of apparatus is correspondingly operative upon vehicle 43. Thus, as is seen in FIG. 3, an endless belt 50 is supported between an idler puller 51 and a drive pulley 52. Belt 50 and pulleys 51 and 52 are preferably fabricated in accordance with conventional fabrication techniques and are supported by conventional means (not shown) in a vertical arrangement beneath slot 22 (seen in FIG. 1). A vehicle carriage 53 is secured to the forwardmost surface of belt 50 and supports toy vehicle 23 such that vehicle 23 is above slot 22 and a portion of vehicle carriage 53 extends through slot 22 to form an attachment between vehicle 23 and belt 50. Carriage 53 further supports an outwardly extending optical sensor 54. In its preferred form, sensor 54 comprises a horseshoe-shaped sensor of conventional fabrication having a gap therebetween. A position plate 60 defining a plurality of apertures 61 is positioned adjacent belt 50 and passes through the gap formed in horseshoe shaped optical sensor 54.

Drive pulley 52 is coupled to a shaft 65 which in turn is coupled to spring loaded idler pulley combination 64. A motor 62 includes an output shaft 63 coupled to the opposite side of idler pulley 64. Push button 21 is operatively coupled to a switch 29 which in turn is coupled to one side of motor 62 and one input to a microprocessor unit 70. Microprocessor 70 is further coupled to motor 62 and to optical sensor 64 via carriage 53. While shown diagrammatically as a direct connection, it will be apparent to those skilled in the art that this is representative and, in operation, the coupling between processor 70 and carriage 53 must accommodate the vertical motion of vehicle 23. This may be obtained by simply providing substantial slack in a wire connection therebetween.

Process 70 is further coupled to a product dispenser unit 71 and a ticket dispenser unit 72. Units 71 and 72 are supported within vending unit 30 shown in FIG. 1.

In operation in response to button 21 having been pushed, switch 29 is closed actuating motor 62 and driving belt 50 such that vehicle carriage 53 and vehicle 23 move downwardly in the direction indicated by arrow 66. As the player releases button 21, switch 29 is actuated to the stop position and motor 62 is stopped. The operation of spring loaded idler combination 64 causes drive pulley 52 to gradually but rapidly stop the vehicle terminating the downward travel of vehicle 23. As vehicle carriage 23 passes along position plate 60, optical sensor 54 begins counting each of the apertures 61 which are passed as vehicle carriage 53 continues downwardly. Once the downward travel of vehicle carriage 53 has ended, the numeric count received at processor 70 is utilized in the above-described scoring operation. In essence, this numeric count is compared first to the number associated with the randomly selected flashing light as described above. Should a match be found, the success of that endeavor is stored within processor 70 awaiting the second portion of game play as the user performs the same game play operation upon toy vehicle 43 (seen in FIG. 1). Once both game play portions have been completed, processor 70 computes the resulting score value and in response to a stored instruction set operates product dispenser 71 or ticket dispenser 72 as required.

What has been shown is a novel vehicle positioning game in which the child user is challenged to accurately stop a descending toy vehicle within a stop zone. The operator is given two chances at each turn and the scores are utilized in combination to form a total score.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle positioning game comprising:

a housing defining a vertical slot having upper and lower ends;

a toy vehicle;

drive means for moving said toy vehicle from said upper end toward said lower end;

a stop zone adjacent said lower end having means for indicating a target stop position within said stop zone;

switch means for operating said drive means; and position means for detecting the position of said toy vehicle within said stop zone.

* * * * *